United States Patent [19]

Maus

[11] Patent Number: 4,498,380

[45] Date of Patent: Feb. 12, 1985

[54] APPARATUS FOR CUTTING FOODSTUFFS

[75] Inventor: Helmut Maus, Pleckhausen, Fed. Rep. of Germany

[73] Assignee: Holac Maschinenbau GmbH, Heidenheim/Brenz, Fed. Rep. of Germany

[21] Appl. No.: 481,646

[22] Filed: Apr. 4, 1983

[30] Foreign Application Priority Data

Apr. 8, 1982 [DE] Fed. Rep. of Germany ..... 3213175

[51] Int. Cl.[3] ..... B30B 15/08

[52] U.S. Cl. ..... 100/98 R; 100/138; 100/232; 83/44

[58] Field of Search ..... 100/94, 95, 96, 97, 100/98 R, 232, 901, 137, 138; 83/44, 56, 57

[56] References Cited

U.S. PATENT DOCUMENTS

| | | | |
|---|---|---|---|
| 1,046,551 | 12/1912 | Cass | 100/98 R |
| 1,549,387 | 8/1925 | Schmithals | 100/232 |
| 3,088,499 | 5/1963 | Rieger | 100/232 X |
| 3,538,844 | 11/1970 | Howard | 100/98 R |
| 3,722,403 | 3/1973 | Longo | 100/98 R X |
| 4,051,757 | 10/1977 | Reifenhäuser et al. | 100/98 R |
| 4,201,128 | 5/1980 | Whitehead et al. | 100/97 X |

*Primary Examiner*—Billy J. Wilhite
*Assistant Examiner*—Christine A. Peterson
*Attorney, Agent, or Firm*—Walter H. Schneider

[57] ABSTRACT

An apparatus for cutting foodstuffs and the like. The apparatus comprises an open-end cutting compartment of rectangular cross-sectional configuration provided with a fixed lateral wall and an oppositely positioned movable lateral press wall. Positioned above and communicating with the cutting compartment is a foodstuff holding compartment from which foodstuff is fed to the cutting compartment. A plate for covering the opening between the holding and cutting compartments is associated with a compacting piston which retracts and repositions the press wall for pre-pressing foodstuff in the cutting compartment. One end of the cutting compartment is provided with means for cutting the foodstuff while the other end is provided with a piston for forcing the foodstuff through the cutting compartment and against the cutting means. A compacting wall for contacting the foodstuff during lateral pre-pressing of the foodstuff is positioned in front of and is adapted to be contacted by the press wall. Means are provided for varying the extent of retraction of the compacting wall with respect to the extent of retraction of the press wall.

7 Claims, 10 Drawing Figures

APPARATUS FOR CUTTING FOODSTUFFS

BACKGROUND OF THE INVENTION

1. Field of the Invention

The present invention relates generally to improvements in or relating to apparatus for cutting foodstuffs and the like materials. More particularly, the present invention relates to a cutting apparatus for cutting foodstuffs and the like into strips, cubes, slices and the like shapes. Still more particularly, the present invention is concerned with a cutting apparatus in which the material to be cut is introduced into a cutting compartment in which the material is pressed against a cutting device.

2. Description of the Prior Art

German Pat. No. 17 79 153 describes an apparatus for cutting foodstuffs into slices, strips or cubes in which the foodstuff is moved downwardly from a holding compartment into a cutting compartment. Simultaneously with a lateral pre-pressing of the foodstuff in the cutting compartment effected by means of a compacting piston, communication between the holding and cutting compartments is interrupted by means of a cover plate arranged in its open position at the side of the cutting compartment opposite to that of the compacting piston. Movement of the cover plate to its closed position is made in conjunction with, but in counter-cyclic movement to, the movement of the compacting piston when effecting lateral pre-pressing of the foodstuff. Once placement of the cover plate in its closed position is concluded, foodstuff is fed through the cutting compartment to cutting knives located at one end of the compartment by means of a magazine piston operating against the foodstuff at the opposite end of the compartment. While the described apparatus normally functions in a satisfactory manner, its compacting piston-cover plate arrangement is rather complex in structure and function and, moreover, tends to complicate and render cumbersome the required periodic cleaning of the cutting apparatus.

SUMMARY OF THE INVENTION

There has continued to remain, therefore, a need for an improved apparatus for cutting foodstuffs and the like of the type generally described above. It is an object of this invention to provide such an improved foodstuff cutting apparatus.

In accordance with the present invention, there is provided an apparatus for cutting foodstuffs into slices, strips or cubes comprising an open-ended tubular cutting compartment or magazine of rectangular cross-sectional configuration open at its top and provided with a lateral compacting wall movable with respect to the opposite, but fixed, lateral wall. Associated with and located at the forward open end of the cutting compartment are means for cutting foodstuff fed through the cutting compartment by a magazine piston located and operating through the rearward end of the compartment. Positioned to the rear of the compacting wall is a press wall operatively connected to the compacting piston and adapted to contact and move the compacting wall in a direction to and from the fixed lateral wall and transversely to the direction of movement of the magazine piston.

Positioned above the cutting compartment and in communication therewith is a foodstuff holding compartment. Communication between the two compartments can be interrupted by means of a cover plate associated with the compacting piston. This cover plate may by simply a right angle extension of the press wall or may be, alternatively, separately secured to the compacting piston by appropriate means. In either event, forward movement of the compacting piston to laterally move the press wall will, simultaneously, move the cover plate to its closed position thereby interrupting communication between the holding and cutting compartments. On reverse movement of the compacting piston, the cover plate will be retracted thereby reestablishing communication between the two compartments.

In accordance with a preferred embodiment of the invention, means are provided for varying the distance by which the compacting wall is moved on retraction of the compacting piston, thereby correspondingly varying the volume of the cutting chamber to which foodstuff is fed and the subsequent prepressing of such foodstuff on the forward movement of the compacting wall. This distance can be predetermined over a wide range from a point of no retraction and, correspondingly, no subsequent pre-pressing of the foodstuff, to a substantial retraction with a corresponding substantial pre-pressing. By this embodiment, therefore, the cutting apparatus can be effectively used with a variety of foodstuff materials.

In the drawings, which illustrate that which is presently regarded as the best mode of carrying out the invention, FIG. 1 is a side view of one embodiment of a cutting apparatus in accordance with the present invention.

Figure 6:
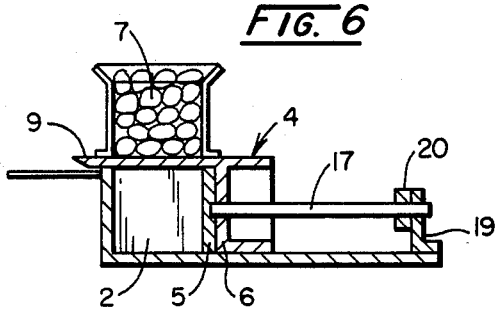
Figure 7:
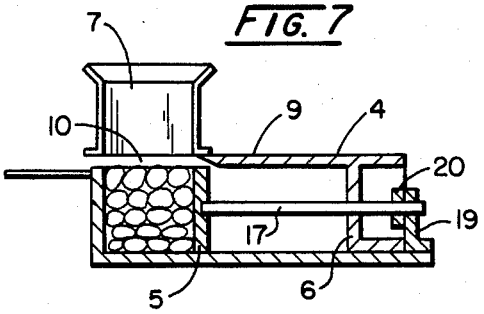

FIGS. 6 and 7 indicate a feeding of material without lateral compacting.

Figure 8:
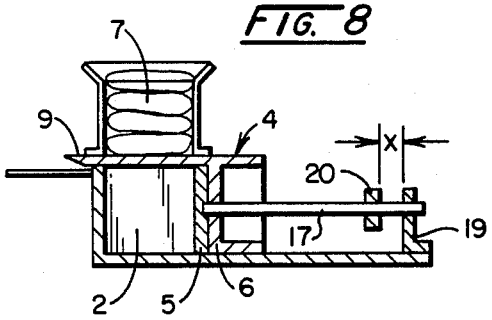
Figure 9:
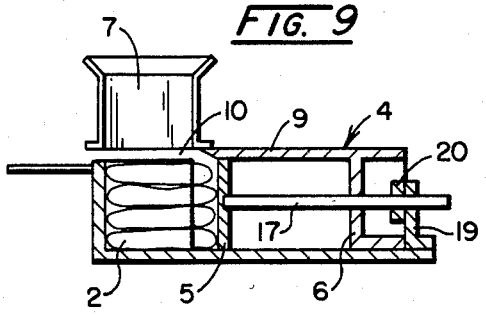

FIGS. 8 and 9 indicate an example of feeding of material where a low lateral compacting is carried out.

Figure 10:
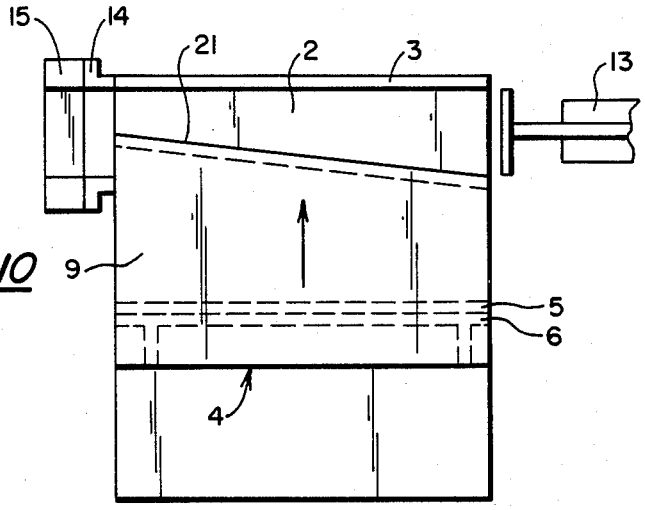

FIG. 10 is a top plan view of a cutting apparatus with a cutting edge which extends at an angle with respect to the longitudinal axis of the magazine piston.

Figure 1:
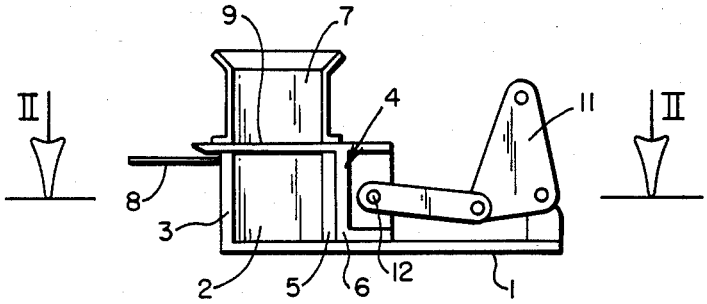
Figure 2:
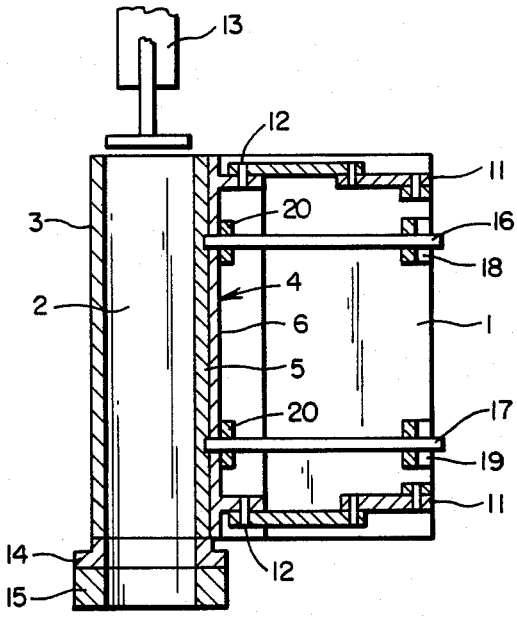
FIG. 2 is a cross section along line II—II in FIG. 1.

Referring, now, to FIGS. 1 and 2 of the drawings, reference numeral 1 represents a bottom wall of a cutting apparatus on which is situated a cutting compartment 2 of rectangular cross-sectional configuration comprising a fixed lateral wall 3. Opposite and parallel to fixed wall 3 is a compacting piston 4 which is designed to move lateral compacting wall 5 to and from with respect to lateral wall 3 by means of press wall 6 with which it is operatively connected. Positioned above cutting compartment 2 and communicating therewith is a foodstuff holding compartment 7 from which foodstuff is fed by gravity to cutting compartment 2. Positioned laterally along side cutting compartment 2 is a cover 8 for covering the cutting apparatus.

In the upper region, more precisely, on the upper side of the pre-pressing or compacting piston 4, there is provided a cover plate 9 which is of unitary construction with the press wall 6 of the piston 4. The cover plate 9 extends at right angle, in the direction to the oppositely disposed lateral wall 3 of the cutting compartment 2. The width of the cover plate 9 is selected in such a way that in the closed condition, i.e. when the compacting piston 4 is in the forward or extended position, the inlet opening 10, shown in FIG. 4, between the holding compartment 7 and the cutting compartment 2, is fully covered or closed by the cover plate 9.

The horizontal displacement movement of the compacting piston 4 is carried out in a manner known per se by means of a toggle lever system 11. The compacting piston 4 is attached on both sides to a link or joint 12, so as to be swingable about a horizontal axis. As is particularly evident from FIG. 2, on the rearward side of the cutting compartment 2 there is arranged a magazine piston 13 which is movable in the longitudinal direction of the cutting compartment 2. The magazine piston 13 serves to press the material to be cut, contained in the cutting compartment 2, in the direction of the cutting knives 14 and 15 which are arranged at the forward, open, end of the compartment 2. The construction and operation of the cutting knives, which may be gang cutting knives or other cutting means, are generally known in the art and need not be described in detail. The knives which move to and fro serve to cut material in the cutting compartment 2 into strips, and the material is removed from the compartment 2 by means of the magazine piston 13. As required, there may be arranged in front of the knives 14 and 15 cutter knives, not shown, for severing the material exiting from the compartment 2.

It is also clear from FIGS. 1 and 2 that the compacting wall 5 is arranged parallel in front of the press wall 6 of the compacting piston 4. The compacting wall 5 is furnished with two guide rods 16 and 17 which are arranged parallel and at a distance to one another. The guide rods 16 and 17 extend with play through openings in the press wall 6, and they are respectively journalled or supported in support or journal blocks 18 and 19, respectively, on the rearward side.

Figure 3:
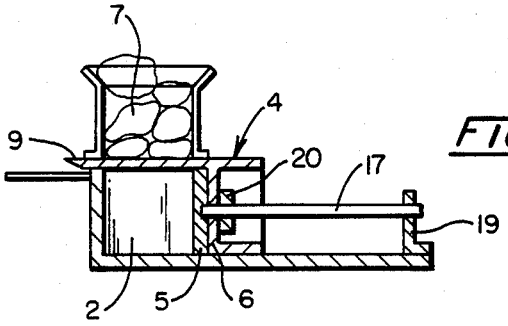
FIGS. 3 to 5 show different phases of operation, with the apparatus being shown in cross section.
Figure 4:
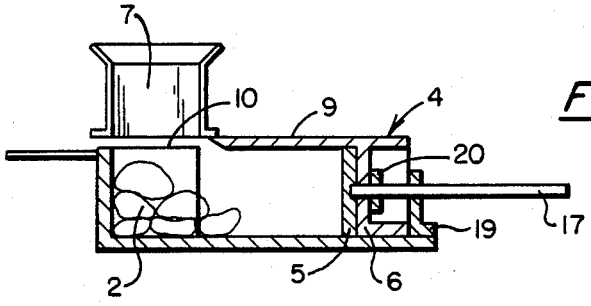
Figure 5:
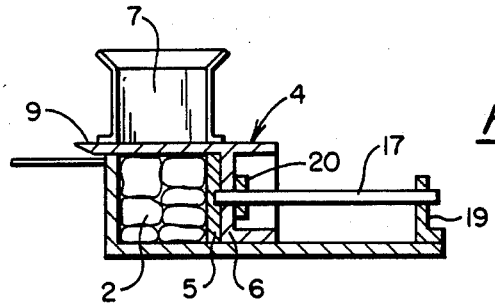

FIGS. 3 to 5 show an operational sequence with lateral compacting of the material to be cut by the compacting wall 5.

FIG. 3 shows the position of the cutting apparatus in which the material to be cut is introduced into the holding compartment 7. In this position, the cover plate 9 closes the inlet opening 10. The two guide rods 16 and 17 are furnished with screw threads which cooperate with threaded rings 20' of the guide rods 16 and 17. If there is to be attained a maximum of lateral compacting of the material, as is indicated in FIGS. 3 to 5, the two rings 20 are fully moved against the rearward side of the press wall 6 of the compacting piston 4, so that the compacting wall 5 is in solid contact with the press wall 6. When the compacting piston 4 is then retracted, whereby simultaneously the inlet opening 10, since there is a rigid connection between the cover plate 9 and the piston 4, compacting wall 5 is fully retracted with the compacting piston 4. Because of the full retraction, there is provided a greater space for the material falling into the cutting compartment 2 from the holding compartment 7. For this, the holding compartment 7 has a volume which is greater than that of the compartment 2. This position is indicated in FIG. 4.

When subsequently the compacting piston 4 is moved to the left again, see FIG. 5, there occurs a lateral compacting of the material to be cut, with the compacting being carried out by the compacting wall 5.

FIGS. 6 and 7 show a feeding example in which no lateral compacting is carried out. As is indicated in FIG. 6, the two rings 20 are moved to the farthest position to the right near the pertaining support blocks 18 and 19. When the compacting piston 4 is retracted to the right, for filling of the cutting compartment 2, whereby the inlet opening 10 is also uncovered, the compacting wall 5 remains in its forward position, in which it forms a lateral wall of the compartment 2. Due to the arrangement of the guide rods 16 and 17, which are positioned with play in corresponding openings, not shown in detail, in the compacting piston 4, the piston 4 can be retracted alone. The material to be cut is then positioned without being compacted in the compartment 2. Subsequently, the compacting piston is moved again to the left, whereby the inlet opening 10 is closed again, and the cutting process can be initiated by a corresponding advance of the magazine piston 13.

FIGS. 8 and 9 show a cutting apparatus in which a minor or low lateral compacting is carried out. This is achieved in a manner indicated in FIG. 8 in which the two rings 20 are positioned at a distance 'x' ahead of the two support blocks 18 and 19. When the compacting piston 4 is now retracted, then, initially, the compacting wall 5 remains in its forward position. Near the conclusion of retracting of the compacting piston 4, the two rings 20 abut the piston 4, and the compacting wall is also retracted, in conformity with the amount of distance 'x'. This provides for a minor compacting of the material which, as required, can be selected as desired, with the selection being possible from a range of from maximum compacting to near 'o' compacting.

In FIG. 10, cover plate 9 is shown as provided with a cutting edge 21 for severing the foodstuff material upon completion of the feeding thereof to cutting compartment 2. In order to achieve a drawing cut, the cutting edge 21 extends at an angle or at a slant with respect to the lateral wall 3 of the compartment 2.

Reference in this disclosure to details of the specific embodiments is not intended to restrict the scope of the appended claims, which themselves recite those features regarded as essential to the invention.

I claim:

1. An apparatus for cutting foodstuffs and the like comprising an open-end, open-top tubular foodstuff cutting compartment formed by a bottom wall and two lateral side walls one of which is a press wall movable with respect to the other, fixed side wall and which, in its unretracted or closed position, forms therewith a compartment of rectangular cross-sectional configuration; an open-bottm foodstuff holding compartment of similar cross-sectional configuration positioned above said cutting compartment and communicating therewith whereby foodstuff can be fed thereto; foodstuff cutting means positioned at one end of said cutting compartment and a piston at the other end for moving foodstuff therethrough and against said cutting means; a cover plate located on the same side of the cutting compartment as said press wall for closing communication between said holding and said cutting compartments; a movable compacting wall located in front of, and adapted to be contacted by, said press wall; and a foodstuff compacting piston operatively associated with said press wall and said cover plate for simultaneously retracting both from their closed positions along an axis perpendicular to the axis of movement of said cutting compartment whereby foodstuff is fed from said holding compartment into a resultant laterally expanded cutting compartment, and for simultaneously returning said press wall and said cover plate to their closed positions whereby communication between said holding and cutting compartments is closed by said cover plate and foodstuff fed into said cutting compartment is subjected to a lateral pre-pressing in the direction of said fixed wall by said compacting wall.

2. An apparatus according to claim 1 in which said cover plate and said press wall are of unitary construction.

3. An apparatus according to claim 2 in which said cover plate includes a cutting edge at its forward end extending at an angle with respect to said fixed wall.

4. An apparatus according to claim 3 in which said cover plate serves as a top wall for said resultant laterally expanded cutting compartment formed when said press wall and said cover plate are retracted.

5. An apparatus according to claim 1 in which means are provided by which said compacting wall can be retracted a predetermined distance in conjunction with the retraction of said press wall, said distance being variable in terms of retraction of said compacting wall from that of no retraction, to that essentially equivalent to the retraction of said press wall, the extent of lateral expansion of said cutting compartment being correspondingly varied.

6. An apparatus according to claim 5 in which said variable retracting means comprises at least one guide rod which secures said compacting wall to a support positioned to the rear of said compacting piston, said press wall being adapted to freely move on said guide rod as it is retracted from and returned to it closed position, said guide rod being provided with adjustable means for engaging said press wall during its retraction and return whereby the point of at which retraction of said compacting wall is initiated can be selectively predetermined.

7. An apparatus according to claim 6 in which said adjustable means comprises a threaded guide rod cooperating with a correspondingly threaded stop ring carried thereon.

* * * * *